United States Patent [19]

Masuda et al.

[11] 3,957,493

[45] May 18, 1976

[54] THERMODEVELOPABLE PHOTOGRAPHIC MATERIAL WITH N-HALOACETAMIDE

[75] Inventors: Takao Masuda, Asaka; Keiichi Adachi, Minami-ashigara, both of Japan

[73] Assignee: Fuji Photo Film Co., Ltd., Minami-ashigara, Japan

[22] Filed: Dec. 26, 1973

[21] Appl. No.: 427,612

[30] Foreign Application Priority Data

Dec. 26, 1972 Japan ..... 48-2842

[52] U.S. Cl. ..... 96/114.1; 96/109; 96/114.6; 96/67

[51] Int. Cl.[2] ..... G03C 1/02; G03C 1/34; G03C 1/76

[58] Field of Search ..... 96/109, 76 R, 114.1, 96/67

[56] References Cited

UNITED STATES PATENTS 2,394,600 2/1946 Fallesen et al. ..... 96/109

*Primary Examiner*—David Klein
*Assistant Examiner*—L. X. Falasco
*Attorney, Agent, or Firm*—Sughrue, Rothwell, Mion, Zinn & Macpeak

[57] ABSTRACT

A thermodevelopable light-sensitive material having a reduced frequency to fog formation by heat, comprising a support and at least one layer containing (a) an organic silver salt, (b) a catalytic amount of a light-sensitive silver halide or a compound capable of forming a light-sensitive silver halide by reaction with the organic silver salt (a), (c) a reducing agent (d) a binder, and (e) an N-haloacetamide. In order to increase the transparency of the thermodevelopable photographic layer of the material and the density of the image and to improve its preservability, a topcoating of polymer can be formed on the light-sensitive layer.

20 Claims, No Drawings

THERMODEVELOPABLE PHOTOGRAPHIC MATERIAL WITH N-HALOACETAMIDE

BACKGROUND OF THE INVENTION

1. Field of the Invention

This invention relates to a thermodevelopable photographic material, and particularly to a thermodevelopable photographic material containing a compound which inhibits fog caused by heating (development) (to be referred to hereinafter for brevity simply as "fog").

2. Description of the Prior Art

Photographic methods utilizing silver halide have previously gained the most widespread acceptance because they give rise to superior photographic characteristics such as sensitivity and gradation to methods such as electrophotography or diazotype photographic processes. The silver halide photographic materials used in these methods are first developed with a developer after imagewise exposure, and then in order for the developed image not to discolor or fade under normal illumination, or for the undeveloped part (to be referred to hereinafter as background) not to turn black, the materials must be subjected to treatments such as stopping, fixation, rinsing or stabilization. Accordingly, the processing of a photographic material is time-consuming and requires much labor; moreover, the handling of various chemicals involves risks to the human body, and also the contamination of the processing chamber or the hands or garments of the working personnel. It is therefore very desirable to improve the photographic processes which use silver halides so that the processing of the photographic material can be performed in the dry state without using a solution treatment, and the processed image is maintained stable.

Various efforts have been made with a view to achieving this improvement. One of these efforts has resulted in a photographic process using a thermodevelopable photographic material comprising, as a photographic element, a major amount of a silver salt of a long-chain aliphatic carboxylic acid and a catalytic amount of a silver halide as is disclosed in U.S. Pat. Nos. 3,152,904; 3,457,075; 3,635,719; 3,645,739 and 3,756,829 and Japanese Pat. No. 22185/70.

When, for example, a photographic material comprising a composition consisting of a fatty acid-silver salt, a reducing agent and a catalytic amount of a silver halide, as one of the thermodevelopable photographic materials heretofore proposed, is heated, an oxidation-reduction reaction between the fatty acid-silver salt and the reducing agent occurs due to the catalytic action of the silver halide at the exposed portion to form a silver image; however, at the same time, an oxidation-reduction reaction proceeds also at the non-exposed portion to cause undesirable fog.

In an attempt to prevent fog formation, a method has already been proposed in which a compound capable of donating a mercury ion is used. For example, U.S. Pat. No. 3,589,903 discloses that a thermodevelopable material having a reduced tendency toward fog formation can be obtained by incorporating a compound capable of donating a mercury ion into a composition consisting of an organic silver salt, a reducing agent and a catalytic amount of a light-sensitive silver halide. Since in this technique, the compound donating a mercury ion also acts as a light-sensitive silver halide, the use of the light-sensitive silver halide can be omitted.

As is well known, however, mercury compounds are toxic, and the photographic processing operation could be very risky. Furthermore, if unwanted coating solutions containing mercury ions are discarded into rivers or the like, the mercury level builds up in fish and shell-fish, and will cause serious problems upon human consumption. Also when photographic materials containing mercury compounds are re-used, for example, as regenerated paper, the mercury compounds flow out likewise causing problems.

Accordingly, an object of this invention is to provide a thermodevelopable photographic material containing a compound which is not toxic, in contrast to mercury compounds, but possesses a fog inhibiting effect, as with the mercury compounds.

Another object of this invention is to provide a thermodevelopable photographic material whereby the image obtained after development has reduced discoloration by light.

Still another object of this invention is to provide a thermodevelopable photographic material which can give good quality images free from fog and having high image density and good contrast.

SUMMARY OF THE INVENTION

Extensive investigations by the inventors have led to the discovery that these objects can be achieved by incorporating an N-haloacetamide into a thermodevelopable photographic material containing an organic silver salt, a catalytic amount of a silver halide or of a compound capable of forming a silver halide by reaction with the organic silver salt, and a reducing agent.

According to this invention, there is provided a thermodevelopable photographic material comprising a support and at least one layer containing (a) an organic silver salt, (b) a catalytic amount of a light-sensitive silver halide or a compound capable of forming a light-sensitive silver halide by reaction with the organic silver salt (a), (c) a reducing agent, (d) a binder, and (e) and N-haloacetamide.

DETAILED DESCRIPTION OF THE INVENTION

The organic silver salt which can be used in this invention can be a silver salt of an organic compound containing an imino group, a mercapto group or a carboxyl group. Specific examples of such silver salts are benzotriazole-silver, saccharin-silver, phthalazinone-silver, 3-mercapto-4-phenyl-1,2,4-triazole-silver, a silver salt of 4-hydroxy-6-methyl-1,3,3a,7-tetrazaindene, a silver salt of 2-(s-ethylthioglycol amide)-benzothiazole, silver caprylate, silver laurate, silver myristate, silver palmitate, silver stearate, and silver behenate. Suitable examples of silver salts are disclosed in U.S. Pat. Nos. 3,152,904; 3,457,075; 3,635,719; 3,645,739 and 3,589,903.

The component (b) can be either (1) a compound capable of forming a silver halide by reaction with the silver salt (a), or (2) a silver halide. Specific examples of the compound (1) are (i) inorganic compounds expressed by general formula $MX_n$ wherein M is a hydrogen atom, an ammonium ion or a metal ion (for example, a strontium, cadmium, zinc, tin, chromium, sodium, barium, iron, cesium, lanthanum, copper, calcium, nickel, magnesium, potassium, aluminum, antimony, gold, cobalt, mercury, lead, beryllium, lithium, manganese, gallium, indium, rhodium, ruthenium, palladium, iridium, platinum, thallium, or bismuth ion), X is a halogen atom (a chlorine, bromine, or iodine atom), and $n$ is 1 when M is a hydrogen atom or an ammonium ion, but represents the valency of metal ion when M is a metal ion; and (ii) organic halogen compounds such as triphenylmethyl chloride, triphenylmethyl bromide, 2-bromo-2-methylpropane, 2-bromobutyric acid, 2-bromoethanol, dichlorobenzophenone, iodoform, bromoform, and carbon tetrabromide. Examples of these compounds capable of forming a silver halide are disclosed in U.S. Pat. Nos. 3,152,904; 3,457,075; 3,635,719; 3,645,739 and 3,589,903. Examples of silver halides for compound (2) include silver chloride, silver bromide, silver bromoiodide, silver chlorobromoiodide, silver chlorobromide, and silver iodide.

These silver halides can be in the form of either coarse particles or fine particles, but silver halide emulsions in the form of very fine grains are especially useful. A suitable particle size can range from about 0.005 to 0.5$\mu$.

Emulsions containing light-sensitive silver halides can be prepared using any desired method known in the photographic art. The emulsions can, for example, be those obtained using a single jet method, those obtained using a double jet method, Lippmann emulsions, ammonia-process emulsions, or thiocyanate or thioether ripened emulsions, or those disclosed in U.S. Pat. Nos. 2,222,264; 3,320,069 and 3,271,157.

The silver halides which can be used in this invention can be sensitized using, for example, a reducing agent, a sulfur or selenium compound, or a gold, platinum or palladium compound, which are generally used as chemical sensitizers for silver halides. Suitable sensitizing methods are disclosed, for example, in U.S. Pat. Nos. 2,623,499; 2,399,083; 3,297,447 and 3,297,446.

The compounds as component (b) can be used either alone or in combination of two or more. A suitable amount of the component (b) is from about 0.001 to 0.5 mol, preferably 0.01 to 0.1 mol, per mol of the organic silver salt. If the amount of the component (b) is smaller than the lower limit of this range, the sensitivity of the photographic material is reduced. If the amount is larger than the upper limit of this range, the non-image portion of the thermodeveloped photographic material may turn black upon standing under indoor light, which in turn results in an impairment of the contrast between the image portion and the non-image portion.

The reducing agent as component (c) which is used in this invention must be one suitable for reducing the organic silver salt to a silver image when heated in the presence of a catalytic amount of the exposed silver halide. Suitable reducing agents are determined based on the organic silver salt, and examples are disclosed in U.S. Pat. Nos. 3,152,904; 3,457,075; 3,635,719; 3,645,739 and 3,589,903. Specific examples include substituted phenols, substituted or unsubstituted bisphenols, substituted or unsubstituted naphthols, di- or poly-hydroxybenzenes, di- or poly-hydroxynaphthalenes, hydroquinone monoethers, ascorbic acid or its derivatives, 3-pyrazolidones, pyrazoline-5-ones, reducible saccharides, kojic acid, and hinokitiol.

More specific examples of such reducing agents are hydroquinone, methylhydroquinone, chlorohydroquinone, bromohydroquinone, phenylhydroquinone, hydroquinone monosulfonic acid salt, t-octylhydroquinone, t-butylhydroquinone, 2,5-dimethylhydroquinone, 2,6-dimethylhydroquinone, methoxyhydroquinone, ethoxyhydroquinone, p-methoxyphenol, p-ethoxyphenol, hydroquinone monobenzyl ether, catechol, pyrogallol, resorcinol, p-aminophenol, o-aminophenol, N-methyl-p-aminophenol, 2-methoxy-4-aminophenol, 2,4-diaminophenol, 2-$\beta$-hydroxyethyl-4-aminophenol, p-t-butylphenol, p-t-amylphenol, p-cresol, 2,6-di-t-butyl-p-cresol, p-acetophenol, p-phenylphenol, o-phenylphenol, 1,4-dimethoxy-phenol, 3,4-xylenol, 2,4-xylenol, 2,6-dimethoxyphenol, sodium 1-amino-2-naphthol-6-sulfonate, 1-naphthylamine-7-sulfonic acid, 1-hydroxy-4-methoxy-naphthalene, 1-hydroxy-4-ethoxy-naphthalene, 1,4-dihydroxynaphthalene, 1,3-dihydroxynaphthalene, 1-hydroxy-4-aminonaphthalene, 1,5-dihydroxynaphthalene, 1-hydroxy-2-phenyl-4-methoxynaphthalene, 1-hydroxy-2-methyl-4-methoxy-naphthalene, $\alpha$-naphthol, $\beta$-naphthol, 1,1'-dihydroxy-2,2'-binaphthyl, 4,4'-dimethoxy-1,1'-dihydroxy-2,2'-binaphthyl, 6,6'-dibromo-2,2'-dihydroxy-1,1'-binaphthyl, 6,6'-dinitro-2,2'-dihydroxy-1,1'-binaphthyl, bis(2-hydroxy-1-naphthyl) methane, bisphenol A, 1,1-bis-(2-hydroxy-3,5-dimethylphenyl)-3,5,5-trimethylhexane, 2,4,4-trimethylpentyl-bis-(2-hydroxy-3,5-dimethylphenyl) methane, bis(2-hydroxy-3-t-butyl-5-methylphenyl) methane, bis(2-hydroxy-3,5-di-t-butylphenyl) methane, 4,4'-methylenebis(3-methyl-5-t-butylphenol), 4,4'-methylenebis(2,6-di-t-butylphenol), 2,2'-methylenebis(2-t-butyl-4-ethylphenol), 2,6-methylenebis(2-hydroxy-3-t-butyl-5-methylphenyl)-4-methylphenol, 3,3',5,5'-tetra-t-butyl-4,4'-dihydroxybiphenyl, l-ascorbic acid, a monoester of l-ascorbic acid, a diester of l-ascorbic acid, p-hydroxyphenyl glycine, N,N-diethyl-p-phenylene diamine, furoin, benzoin, dihydroxyacetone, glycerine aldehyde, rhodizonic acid-tetrahydroxyquinone, methyl gallate, propyl gallate, hydroxytetronic acid, N,N-di(2-ethoxyethyl) hydroxylamine, glucose, lactose, 1-phenyl-3-pyrazolidone, 4-methyl-4-hydroxy-methyl-1-phenyl-3-pyrazolidone, bis(3-methyl-4-hydroxy-5-t-butylphenyl)-sulfide, 3,5-di-t-butyl-4-hydroxybenzyldimethylamine, and $\alpha,\alpha'$-(3,5-di-butyl-4-hydroxyphenyl)-dimethyl ether.

These reducing agents can be used alone or in admixture. Suitable reducing agents are selected depending on the organic silver salt used. For example, a higher fatty acid silver salt such as silver behenate is comparatively difficult to reduce, and therefore, a comparatively strong reducing agent such as a bisphenol, e.g., 4,4'-methylenebis-(3-methyl-5-t-butylphenol), is suitable. On the other hand, for a relatively easily reducible silver salt such as silver laurate, a relatively weak reducing agent such as a substituted phenol, e.g., p-phenylphenol, is suitable. For a silver salt which can be reduced only with difficulty, such as benzotriazole-silver, the use of a strong reducing agent such as an ascorbic acid is suitable.

The amount of the reducing agent cannot unequivocally be set forth because it varies depending on the organic silver salt and reducing agent used. Usually, a suitable amount is about 0.1 to 5 mols, preferably 0.2 to 1 mol, per mol of the organic silver salt.

The most important component used in the thermodevelopable photographic material of this invention is the N-haloacetamide (e) as a heat fog inhibitor. Specific examples of the component (e) are N-bromoacetamide, N-chloroacetamide, and N-iodoacetamide. The amount of the component (e) which is used is suitably about $10^{-4}$ mol to 1 mol, preferably $10^{-3}$ to 0.1 mol, per mol of the organic silver salt. If the amount is less than the lower limit of this range, the heat fog inhibiting effect is poor, and if it is larger than the upper limit, the photographic properties of the photographic material are deteriorated, for example, the density of the image is reduced.

Preferably, the component (e) is incorporated into the photographic material as a solution in a suitable solvent. It is preferable that the component (e) be added to the organic silver salt (a) before or after its preparation, or to the silver halide [component (b)] before or after its preparation. Alternatively, a layer consisting of the components (a), (b), (c) and (d) is first formed on a support, and then this layer is immersed in a solution of the component (e), or a layer of the component (e) is provided adjacent a layer containing component (a) and/or component (b).

Preferably, the components (a), (b), (c) and (e) are dispersed in a binder, and then coated on a support. A suitable coating amount can range from about 0.2 to 3g/m$^2$, preferably 0.3 to 1.5g/m$^2$, of silver on the support. Or they can be coated, either partly or completely, as separate layers. The binder which can be used can be those conventionally used in the art. Usually, hydrophobic binders are suitable, but hydrophilic binders can also be used. Preferably, these binders are transparent or semi-transparent, and can, for example, be natural substances such as gelatin, gelatin derivatives, or mixtures of these with latex-form vinyl polymers, or cellulose derivatives, and synthetic polymers. Specific examples include gelatin, phthalic-modified gelatin, polyvinyl butyral, polyacrylamide, cellulose acetate butyrate, cellulose acetate propionate, polymethyl methacrylate, polyvinyl pyrrolidone, polystyrene, ethyl cellulose, polyvinyl chloride, chlorinated rubbers, polyisobutylene, a butadiene/styrene copolymer, a vinyl chloride/vinyl acetate copolymer, a vinyl acetate/vinyl chloride/maleic acid copolymer, polyvinyl alcohol, polyvinyl acetate, benzyl cellulose, cellulose acetate, cellulose propionate, and cellulose acetate phthalate. These compounds can be used in admixture of at least two as is required.

A suitable amount of the binder is a ratio of 4:1 to 1:4 by weight based on the organic silver salt.

If the compound (a) or (c) is a high molecular weight substance which can concurrently act as a binder, the use of component (d) can be omitted.

A wide variety of materials can be used in this invention as a support of the photographic material. Typical examples are a cellulose nitrate film, a cellulose ester film, a poly (vinyl acetal) film, a polystyrene film, a poly (ethylene terephthalate) film, a polycarbonate film, a glass sheet, paper, or a metal sheet.

An antistatic layer or electrically conducting layer can be provided in the thermodevelopable photographic material of this invention. It is also possible to incorporate an antihalation substance or an antihalation dye in the thermally developable photographic material of this invention. Examples of these layers are disclosed in British Pat. Nos. 1,261,102 and 1,276,727 and U.S. Pat. No. 3,745,009.

If desired, the thermodevelopable photographic material of this invention can further contain a matting agent such as starch, titanium dioxide, zinc oxide or silica, or a fluorescent brightening agent such as a stilbene, triazine, oxazole or coumarine.

The thermodevelopable photographic layer used in the performance of the present invention can be coated using various techniques, for example, the immersion method, the air knife method, the curtain coating method, or the extrusion coating method using a hopper as is disclosed in U.S. Pat. No. 2,681,294. If desired, two or more layers can be coated at one time.

Some of the optical sensitizing dyes which have previously proved effective for silver halide photographic emulsions can be advantageously used to provide additional photosensitivity to the thermodevelopable photographic material of this invention. For example, the thermodevelopable photographic material of this invention can be optically sensitized by adding a sensitizing dye as a solution or dispersion in an organic solvent. Examples of useful optical sensitizing agents are the cyanine and merocyanine dyes as disclosed in U.S. Pat. Nos. 3,719,495 and 3,761,279. The amount of the sensitizing dye is about $10^{-6}$ to about $10^{-2}$ mol per mol of the organic silver salt.

In order to increase the transparency of the thermodevelopable photographic layer and the density of the image, and also improve the fresh stability of the photographic material (the property of the photographic material to maintain its photographic characteristics which exist immediately after its preparation even at the end of storage), a topcoat of a polymer can be formed on the photosensitive layer. A suitable thickness of the topcoat polymer is from about 1 to 20 microns. Examples of suitable polymers which can be used for this purpose are polyvinyl chloride, polyvinyl acetate, a copolymer of vinyl chloride and vinyl acetate, polyvinyl butyral, polystyrene, poly (methyl methacrylate), polyurethane rubber, a xylene resin, benzyl cellulose, ethyl cellulose, cellulose acetate butyrate, cellulose acetate, polyvinylidene chloride, chlorinated polypropylene, polyvinyl pyrrolidone, cellulose propionate, polyvinyl formal, cellulose acetate phthalate, polycarbonate, and cellulose acetate propionate.

The thermodevelopable photographic material described above is developed merely by exposing it to irradiation from a light source such as a xenon lamp, a tungsten lamp or a mercury lamp, and then heating it. A suitable heating temperature is from about 100° to 160°C., preferably 110° to 140°C. Higher or lower temperatures within this range can be employed by prolonging or shortening the heating time. A developing time is usually about 1 to 60 seconds.

Various means are available to develop the photographic material of this invention by heating. For example, the photographic material can be brought into contact with a heating plate or with a heated drum, or can be passed through heated air. Alternatively, the heating can be effected using high frequency induction heating, or using laser beams.

The thermodevelopable photographic material of this invention has a reduced tendency toward fog formation and gives a high image density. Furthermore, there is a reduced discoloration of the developed photographic material by light. Accordingly, the use of the thermodevelopable photographic material of this invention makes it possible to form clear images of shap contrast for prolonged periods of time.

The following Examples illustrate the present invention in greater detail. Unless otherwise indicated, all parts, percents, ratios and the like are by weight.

EXAMPLE 1

Behenic acid (3.4g) was dissolved at 60°C in 100ml of toluene, and the solution was maintained at 60°C. While stirring the solution with a stirrer, 100ml of a dilute aqueous solution of nitric acid to adjust the pH to 2.0 at 25°C was mixed with the solution. The mixed solution was maintained at 60°C, and with stirring with a stirrer, an aqueous solution obtained by adding aqueous ammonia to about 80ml of an aqueous solution containing 1.7g of silver nitrate to form a silver.ammonium complex salt and further adding water to make the total amount 100ml was added thereby to form a dispersion containing microcrystals of silver behenate. When the dispersion was allowed to stand for 20 minutes, it separated into an aqueous layer and a toluene layer.

The aqueous phase was first removed, and the toluene phase was washed with 400ml of water by the decantation method. This operation was repeated three times, and then after adding 400ml of toluene, it was subjected to centrifugal separation to collect the silver behenate. There was obtained 4g of silver behenate in the form of spindles each of which measured about 1 micron along its long side and about 0.05 micron along its short side.

The silver behenate (2.5g) was added to 20ml of an isopropyl alcohol solution containing 2g of polyvinyl butyral, and the mixture was processed in a ball mill for 1 hour to form a polymer dispersion of the silver behenate. The following ingredients were added to 20ml of this polymer dispersion of the silver behenate to 20ml of this polymer dispersion of the silver behenate to form a thermodevelopable photographic composition.

| Formulation of the Composition | |
|---|---|
| Ammonium Bromide (2.5% by weight methanol solution) | 1ml |
| Benzoxazolylidene Rhodanine (color sensitizing dye) as a 0.025% by weight chloroform solution | 1ml |
| 2,2'-Methylenebis(6-t-butyl-4-methyl-phenol) (a 2.5% by weight methyl cellosolve solution) | 3ml |
| Phthalazinone (a 2.5% by weight methyl cellosolve solution) | 1ml |
| N-Bromoacetamide (a 5% by weight methyl cellosolve solution) | 1ml |
| Tetrachlorophthalic Anhydride (a 0.6% by weight methanol solution) | 1ml |

The resulting composition was coated on a polyethylene terephthalate film in an amount of 1.5g (as silver) per square meter of the support film, thereby to form a thermodevelopable photographic material (A). For comparison, a thermodevelopable photographic material (B) was prepared in the same manner as described above except that the N-bromoacetamide as a heat fog inhibitor was not added. Furthermore, a thermodevelopable photographic material (C) was prepared in the same manner as above except that 1ml of a 5% by weight methanol solution of mercuric bromide was used instead of the ammonium bromide, and the N-bromoacetamide as a heat fog inhibitor was not added.

Each of these photographic materials was exposed to an exposure of 240,000 luxes.second from a tungsten light source, and then developed by heating for 10 seconds at 120°C. Then, the blackening transmission density of the developed photographic materials was measured. Furthermore, other pieces of the photographic materials (A) to (C) were heated at 120°C for 10 seconds without exposing them. The transmission density was measured, and the presence of fog was examined.

The standard point of the measurement of the transmission density was set as the base film of the photographic material (In all of the following Examples, this standard was applied).

The degree of light discoloration, as shown in the following tables, is expressed by $\Delta D = D_A - D_B$ wherein $D_A$ is the transmission density of the sample after exposure to an indoor fluorescent light, and $D_B$ is the transmission density of the sample immediately after processing and in the unexposed state. This applies to all the following Examples.

The results obtained are shown in the following Table.

| | Photographic Material | | |
|---|---|---|---|
| | (A) | (B) | (C) |
| Blackening Transmission Density | 1.8 | 2.2 | 1.0 |
| Heat Fog | 0.13 | 0.4 | 0.13 |
| Degree of Light Discoloration (ΔD) | +0.10 | +0.34 | +0.35 |

The results obtained demonstrate that the N-bromoacetamide [Component (e)] has a remarkable heat fog inhibiting effect [compare Photographic Material (A) with Photographic Material (B)].

A comparison of Photographic Material (A) containing N-bromoacetamaide with Photographic Material (C) containing the mercury compound which is a known heat fog inhibitor shows that the degree of heat fog formation is the same for both, but the transmission density of the image increases greatly in Photographic Material (A) to give an image of good contrast. The light discoloration of the background after 24 hours of exposure of the processed photographic material to an indoor fluorescent lamp (about 300 luxes) was less in Photographic Material (A).

Accordingly, the compound as Component (e) used in this invention is less toxic than the mercury compound, and is very desirable for use in this invention.

EXAMPLE 2

The procedure of Example 1 was repeated except that N-chloroacetamide was used in the same amount instead of the N-bromoacetamide. The results obtained are shown in the following table. It is seen that the same effect as in Example 1 was obtained.

| | Photographic Material | | |
|---|---|---|---|
| | (A) | (B) | (C) |
| Blackening Transmission Density | 1.9 | 2.2 | 1.0 |
| Heat Fog | 0.16 | 0.4 | 0.13 |
| Degree of Light Discoloration (ΔD) | +0.20 | +0.34 | +0.35 |

EXAMPLE 3

The procedure of Example 1 was repeated except that the same amount of N-iodoacetamide was used instead of the N-bromoacetamide. The results obtained are shown below. It is seen that the same effect as in Example 1 was obtained.

| | Photographic Material | | |
|---|---|---|---|
| | (A) | (B) | (C) |
| Blackening Transmission Density | 2.1 | 2.2 | 1.0 |
| Heat Fog | 0.18 | 0.4 | 0.13 |
| Degree of Light Discoloration (ΔD) | +0.10 | +0.34 | +0.35 |

EXAMPLE 4

A solution of 11g of lauric acid in 100ml of butyl acetate was maintained at 10°C, and with stirring with a stirrer, 100ml of a dilute aqueous solution of nitric acid (to a pH of 2.0 at 25°C) was mixed with the above solution. With continued stirring, 50ml of an aqueous solution (cooled to 0°C) of a silver nitrate.ammonium complex salt containing 8.5g of silver nitrate was added in the course of 1 minute to allow the lauric acid to react with the silver ion. Silver laurate crystals in the form of spindles, each of which measured about 1 micron along its long side and about 0.05 micron along its short side, were obtained. The silver laurate obtained was washed with water, and then with methanol, and 3.0g of polyvinyl butyral and 20ml of isopropyl alcohol, both based on 2.7g of the silver laurate, were added. The mixture was processed in a ball mill to form a polymer dispersion of the silver laurate.

The following ingredients were added to 20ml of the polymer dispersion to form a thermodevelopable photographic composition. The composition was coated on a polyethylene terephthalate film in an amount of 1.7g as silver per square meter of the support film to form a thermodevelopable photographic material (A). For comparison, a thermodevelopable photographic material (B) was prepared in the same way as described above except that the N-bromoacetamide as a heat fog inhibitor was not added. Furthermore, a thermodevelopable photographic material (C) was also prepared in the same way as described above except that 1ml of a 5% by weight methanol solution of mercuric bromide was used instead of the ammonium bromide and the N-bromoacetamide was not added.

| Formulation of the Composition | |
|---|---|
| Ammonium Bromide (2.5% methanol solution) | 1ml |
| Benzoxazolylidene Rhodanine (a 0.025% by weight chloroform solution) | 1ml |
| p-Phenylphenol (a 70% by weight methyl cellosolve solution) | 3ml |
| Phthalazinone (a 2.5% by weight methyl cellosolve solution) | 1ml |
| Tetrachlorophthalic Anhydride (a 0.6% by weight methanol solution) | 1ml |
| N-Bromoacetamide (a 5% by weight methyl cellosolve solution) | 1ml |

A 15% by weight tetrahydrofuran solution of a copolymer of 95% by weight vinyl chloride and 5% by weight vinyl acetate was further coated on the photosensitive layer of each of the photographic materials (A) to (C) in a dry thickness of 10 microns.

Each of these photographic materials (A) to (C) was given an exposure of 240,000 luxes.second from a tungsten light source, and then heated at 120°C for 10 seconds. Then, the blackening transmission density of the developed photographic materials was measured. Other pieces of the photographic materials (A) to (C) were heated at 120°C for 10 seconds without exposure. The presence of heat fog was examined by measuring the transmission density of the developed photographic materials.

The results obtained are shown below.

| | Photographic Material | | |
|---|---|---|---|
| | (A) | (B) | (C) |
| Blackening Transmission Density | 1.4 | 1.8 | 0.8 |
| Heat Fog | 0.16 | 0.45 | 0.15 |
| Degree of Light Discoloration (ΔD) | +0.15 | +0.42 | +0.45 |

The results obtained demonstrate that the fog of the Photographic Material (A) containing N-bromoacetamide is slightly greater than that of the Photographic Material (C) containing the mercury compound which is a conventional heat fog inhibitor, but the Photographic Material (A) has a higher blackening transmission density to give an image of good contrast. When the processed photographic material was exposed to the indoor illumination of a fluorescent lamp, the light discoloration of the background portion of the photographic material of this invention was extremely reduced as compared with the photographic material containing the mercury compound.

EXAMPLE 5

The procedure of Example 4 was repeated except that the same amount of N-chloroacetamide was used instead of the N-bromoacetamide. The results obtained are shown in the following table. The same effects as in Example 4 were obtained.

| | Photographic Material | | |
|---|---|---|---|
| | (A) | (B) | (C) |
| Blackening Transmission Density | 1.6 | 1.8 | 0.8 |
| Heat Fog | 0.17 | 0.45 | 0.15 |
| Degree of Light Discoloration (ΔD) | +0.21 | +0.42 | +0.45 |

EXAMPLE 6

The procedure of Example 4 was repeated except that the same amount of N-iodoacetamide was used instead of the N-bromoacetamide. The results obtained are shown in the following table. The same effects as in Example 4 were observed.

| | Photographic Material | | |
|---|---|---|---|
| | (A) | (B) | (C) |
| Blackening Transmission Density | 1.6 | 1.8 | 0.8 |
| Heat Fog | 0.18 | 0.45 | 0.15 |
| Degree of Light Discoloration (ΔD) | +0.15 | +0.42 | +0.45 |

EXAMPLE 7

Benzotriazole (6g) was dissolved at 50°C in 100ml of isoamyl acetate, and the solution was cooled to °15°C and maintained at this temperature. With stirring with a stirrer, a solution of 8.5g of silver nitrate in 100ml of a dilute aqueous solution of nitric acid whose pH had been adjusted to 2.0 at 25°C with nitric acid and which was maintained at 3°C was added to the cooled solution, thereby to form a dispersion containing fine crystals of benzotriazole.silver.

When the dispersion was allowed to stand at room temperature (about 20°–30°C) for 20 minutes, it separated into an aqueous phase and an isoamyl acetate phase. The aqueous phase was first removed, and the isoamyl acetate phase was washed with 400ml of water by the decantation method. This operation was repeated three times, and then 400ml of methanol was added. The mixture was subjected to centrifugal separation to collect benzotriazole.silver in an amount of 8g. The benzotriazole.silver particles obtained were nearly spherical with a particle diameter of about 1 micron. The benzotriazole.silver (2.5g) was added to 40ml of an isopropyl alcohol solution containing 4g of polyvinyl butyral. The mixture was processed in a ball mill to form a polymer dispersion of the benzotriazole.silver. The following ingredients were added to 40ml of the polymer dispersion of the benzotriazole.silver to form a thermodevelopable photographic composition.

| Formulation of the Composition | |
|---|---|
| Ammonium Iodide (a 8.5% by weight methanol solution) | 1ml |
| A solution of 2g of Ascorbic Acid Monopalmitate and 2g of Ascorbic Acid Dipalmitate in 10ml of Methyl Cellosolve | 10ml |
| Benzoxazolylidene Rhodanine Sensitizing Dye (a 0.2% by weight chloroform solution) | 1ml |
| N-Ethyl-N'-dodecyl Urea (a 2.5% by weight methyl cellosolve solution) | 2ml |
| N-Bromoacetamide (a 5% by weight methyl cellosolve solution) | 2ml |

The resulting thermodevelopable photographic composition was coated on a polyethylene terephthalate film in an amount of 1.2g as silver per square meter of the support film to form a thermodevelopable photographic material (A).

For comparison, a thermodevelopable photographic material (B) was prepared in the same manner as described above except that the N-bromoacetamide as a heat fog inhibitor was not added. Furthermore, a thermodevelopable photographic material (C) was prepared in the same way as above except that 2ml of a 5% by weight methanol solution of mercuric bromide was used instead of the ammonium iodide, and the N-bromoacetamide as a heat fog inhibitor was not added.

A 15% by weight tetrahydrofuran solution of a copolymer of 95% by weight vinyl chloride and 5% by weight vinyl acetate was coated further on the photosensitive layer of each of the photographic materials (A) to (C) in a dry thickness of 8 microns.

Pieces of these photographic materials (A) to (C) were given an exposure of 1,200,000 luxes.second using a tungsten light source, and heated at 130°C for 30 seconds to develop them. Then, the blackening transmission density of the photographic materials was examined. Furthermore, other pieces of the photographic materials (A) to (C) were heated at 130°C for 30 seconds without exposure, and the presence of fog was examined by measuring the blackening transmission density. The results are shown in the following table.

| | Photographic Material | | |
|---|---|---|---|
| | (A) | (B) | (C) |
| Blackening Transmission Density | 0.95 | 0.92 | 0.60 |
| Heat Fog | 0.13 | 0.38 | 0.12 |
| Degree of Light Discoloration (ΔD) | +0.09 | +0.21 | +0.23 |

It is seen from the results obtained that as compared with the Photographic Material (C) which contained the mercury compound as a known heat fog inhibitor, the heat fog of the Photographic Material (A) containing N-bromoacetamide is great, but the blackening transmission density was high and an image of good contrast was obtained. When the processed photographic material was exposed to the indoor illumination of a fluorescent lamp, the light discoloration of the background was remarkably reduced as compared with the photographic material containing the mercury compound.

EXAMPLE 8

The procedure of Example 7 was repeated except that N-chloroacetamide was used in the same amount instead of the N-bromoacetamide. The results obtained are shown below. The same effects as obtained in Example 7 were obtained.

| | Photographic Material | | |
|---|---|---|---|
| | (A) | (B) | (C) |
| Blackening Transmission Density | 0.90 | 0.92 | 0.60 |
| Heat Fog | 0.14 | 0.38 | 0.12 |
| Degree of Light Discoloration (ΔD) | +0.09 | +0.21 | +0.23 |

EXAMPLE 9

The procedure of Example 7 was repeated except that the same amount of N-iodoacetamide was used instead of the N-bromoacetamide. The results obtained are shown in the following table. The same effects as obtained in Example 7 were observed.

| | Photographic Material | | |
|---|---|---|---|
| | (A) | (B) | (C) |
| Blackening Transmission Density | 0.91 | 0.92 | 0.60 |
| Heat Fog | 0.14 | 0.38 | 0.12 |
| Degree of Light Discoloration (ΔD) | +0.07 | +0.21 | +0.23 |

While the invention has been described in detail and with reference to specific embodiments thereof, it will be apparent to one skilled in the art that various changes and modifications can be made therein without departing from the spirit and scope thereof.

What is claimed is:

1. A thermodevelopable light-sensitive material comprising a support having thereon at least one layer containing (a) an organic silver salt selected from the group consisting of silver salts of organic compounds containing an imino group, a mercapto group or a carboxyl group; (b) from about 0.001 to about 0.5 mol, per mol of said organic silver salt of a light-sensitive silver halide or compound capable of forming a light-sensitive silver halide by reaction with said organic silver salt; (c) a reducing agent suitable for reducing said organic silver salt to a silver image when heated in the presence of said silver halide after said silver halide has been exposed; (d) a binder and, (e) an N-haloacetamide in an amount of from about $10^{-4}$ mol to 1 mol per mol of said organic silver salt.

2. The light-sensitive material of claim 1, wherein the amount of said component (b) is about 0.001 to 0.5 mol per mol of said organic silver salt (a).

3. The light-sensitive material of claim 1, wherein the amount of said component (c) is about 0.1 to 5 mols per mol of said organic silver salt (a).

4. The light-sensitive material of claim 1, wherein the amount of said binder (d) is about 4:1 to 1:4 based on the organic silver salt (a).

5. The light-sensitive material of claim 1, wherein the amount of said component (e) is about $10^{-4}$ mol to 1 mol per mol of the organic silver salt (a).

6. The light-sensitive material of claim 5, wherein the amount of said component (e) is $10^{-3}$ mol to 0.1 mol per mol of the organic silver salt (a).

7. The light-sensitive material of claim 1, wherein said haloacetamide is N-bromoacetamide, N-chloroacetamide or N-iodoacetamide.

8. The light-sensitive material of claim 1, wherein said organic silver salt (a) is a silver salt of an organic compound containing an imino group, mercapto group or carboxyl group.

9. The light-sensitive material of claim 1, wherein said component (b) which is capable of forming a light-sensitive silver halide by reaction with said organic silver salt (a) is selected from the group consisting of (i) inorganic halides of the general formula $MX_n$, wherein M is a hydrogen atom, an ammonium group or a metal atom, X is a halogen atom, and $n$ is 1 when M is a hydrogen atom or an ammonium group or represents the valency of said metal atom when M is a metal, and (ii) organic halogen compounds.

10. The light-sensitive material of claim 1, wherein said reducing agent (c) is selected from the group consisting of substituted phenols, substituted or unsubstituted bisphenols, substituted or unsubstituted naphthols, di- or poly-hydroxybenzenes, di- or poly-hydroxynaphthalenes, hydroquinone monoethers, ascorbic acid, ascorbic acid derivatives, 3-pyrazolidones, pyrazoline-5-ones, reducing saccharides, kojic acid, and hinokitiol.

11. The light-sensitive material of claim 1, wherein said light-sensitive material includes a polymer topcoat layer.

12. The light-sensitive material of claim 11, wherein polymer layer has a thickness of about 1 to 20 microns.

13. The light-sensitive material as described in claim 9, wherein said metal is strontium, cadmium, zinc, tin, chromium, sodium, barium, iron, cesium, lanthanum, copper, calcium, nickel, magnesium, potassium, aluminum, antimony, gold, cobalt, mercury, lead, beryllium, lithium, manganese, gallium, indium, platinum, thallium or bismuth and wherein said X is chlorine, bromine or iodine.

14. The light-sensitive material as described in claim 9, wherein said compound capable of forming a light-sensitive silver halide by the reaction thereof with said organic silver salt (a) is triphenylmethyl chloride, triphenylmethyl bromide, 2-bromo-2-methylpropane, 2-bromobutyric acid, 2-bromoethanol, dichlorobenzophenone, iodoform, bromoform, or carbon tetrabromide.

15. The light-sensitive material as described in claim 1, wherein said light-sensitive silver halide is silver chloride, silver bromide, silver bromoiodide, silver chlorobromoiodide, silver chlorobromide or silver iodide.

16. The light-sensitive material of claim 1, wherein said haloacetamide is N-bromoacetamide.

17. The light-sensitive material of claim 1, wherein said haloacetamide is N-chloroacetamide.

18. The light-sensitive material of claim 1, wherein said haloacetamide is N-iodoacetamide.

19. The light-sensitive material of claim 1, wherein component (b) is a compound capable of forming a light-sensitive silver halide by reaction with said organic silver salt.

20. The light-sensitive material of claim 1, wherein the amount of said component (b) is about 0.001 to 0.5 mol per mol of said organic silver salt (a), the amount of said component (c) is about 0.1 to 5 mols per mol of said organic silver salt (a), the amount of said component (e) is about $10^{-4}$ mol to 1 mol per mol of the organic silver salt (a) and the amount of said binder (d) is about 4:1 to 1:4 based on the organic silver salt (a).

* * * * *